US005294299A

United States Patent [19]

Zeuner et al.

[11] Patent Number: 5,294,299

[45] Date of Patent: Mar. 15, 1994

[54] PAPER, CARDBOARD OR PAPERBOARD-LIKE MATERIAL AND A PROCESS FOR ITS PRODUCTION

[76] Inventors: Manfred Zeuner; Peter Doblanzki, both of Frauenfeld 7, 8359 Ortenburg, Fed. Rep. of Germany

[21] Appl. No.: 13,131

[22] Filed: Feb. 3, 1993

Related U.S. Application Data

[63] Continuation of Ser. No. 536,597, Jun. 28, 1990, abandoned.

[30] Foreign Application Priority Data

Nov. 7, 1988 [DE] Fed. Rep. of Germany ..... 3837746

[51] Int. Cl.[5] ..... D21H 13/36

[52] U.S. Cl. ..... 162/145; 162/152; 162/156; 162/168.1; 162/181.1; 162/181.2; 162/181.3; 162/181.5; 162/181.6; 162/181.8

[58] Field of Search ..... 162/145, 152, 156, 164.6, 162/168.2, 157.1, 181.1, 181.2, 181.3, 181.5, 181.6, 181.8, 175

[56] References Cited

U.S. PATENT DOCUMENTS

| | | | |
|---|---|---|---|
| 3,149,023 | 9/1964 | Bodendorf et al. | 162/175 |
| 3,253,978 | 5/1966 | Bodendorf et al. | 162/175 |
| 3,629,116 | 12/1971 | Gartner et al. | 162/152 |
| 4,385,961 | 5/1983 | Svending et al. | 162/181.6 |
| 4,388,150 | 6/1983 | Sunden et al. | 162/181.6 |
| 4,443,262 | 4/1984 | Piersol et al. | 106/209 |
| 4,643,801 | 2/1987 | Johnson | 162/181.6 |
| 5,017,268 | 5/1991 | Clitherow et al. | 162/183 |

FOREIGN PATENT DOCUMENTS

| | | | |
|---|---|---|---|
| 0099586 | 2/1984 | European Pat. Off. . | |
| 8600100 | 1/1986 | PCT Int'l Appl. | 162/175 |
| 2047297 | 11/1980 | United Kingdom . | |

OTHER PUBLICATIONS

T. Mihara et al, "Inorganic Fiberboard for Heat Insulation", Abstract Bull. of Inst. of Paper Chem., V. 51 (1981) No. 11, p. 1235.

K. Noshiro et al, "Mineral Fiberboard", Abstract Bulletin of Institute of Paper Chem., V. 57, (1987), No. 9, p. 1352.

S. Toyoshima et al, "Inorganic Fiberboard", Abstract Bulletin of Institute of Paper Chem., V. 58 (1987), No. 4, p. 564.

*Primary Examiner*—Peter Chin

*Attorney, Agent, or Firm*—Sprung Horn Kramer & Woods

[57] ABSTRACT

Paper, cardboard or paperboard-like material containing inorganic fibres, inorganic particle-like additives and organic binders and flocculating agents characterized in that (1) the particle-like inorganic additives constitute 40–80% by weight of the dry matter of the material;

(2) the inorganic particle-like additives are composed of (2.1) a base filler of which at least 20% by weight has a particle size of $<2$ μm and not more than 20% by weight has a particle size of $>20$ μm on the one hand and $<0.5$ μm on the other hand, and (2.2) an anionic flocculating active pigment of which at least 50% by weight has a primary particle size of $<2$ μm, (3.1) the organic flocculating agent is a cationic polymeric carbohydrate with an average molecular weight of 100,000 to 2,000,000 and a degree of substitution of 0.01 to 0.3 and is present in a quantity of 0.5 to 6% by weight, based on the dry matter of the material, and (3.2) 1000 g of base filler is unable to bind more than 0.1 mMol and 1000 g of anionic flocculating active pigment is able to bind at least 0.1 mMol cationic carbohydrate under flocculation.

30 Claims, No Drawings

PAPER, CARDBOARD OR PAPERBOARD-LIKE MATERIAL AND A PROCESS FOR ITS PRODUCTION

This application is a continuation, of application Ser. No. 536,597, filed Jun. 28, 1990, now abandoned. This application is a continuation of international application Ser. No. PCT/EP89/01287 filed Oct. 28, 1989, now abandoned.

The present invention relates to paper, cardboard or paperboard-like material with a very high portion of inorganic constituents, namely inorganic fibres and inorganic particle-like additives, i.e. fillers and pigments.

It is generally known that the strength of paper based on organic fibres is dependent on the formation of hydrogen bonds between the organic fibres. It is also known that by mechanically separating the fibres from one another the inorganic fillers reduce the fibre surfaces available for binding with hydrogen bonds or block the spots on the fibre capable of binding and replace them with weaker fibre-filler-fibre bonds, whereby fine fillers reduce the strength considerably.

Thus, if only inorganic fibres and fillers are used during the manufacture of paper or paperboard-like materials, i.e. substances that are not capable of binding with hydrogen bonds, then the strength of the materials obtained is low.

Paper-like materials containing inorganic fibres such as glass fibres or mineral wool fibres, inorganic particle-like fillers such as clay and bentonite, and hydrolyzed starch as the organic binder are known from EP-A-0 109 782 and EP-A-0 027 705. However, organic fibres are also used to improve strength and reduce brittleness.

A process for the continuous manufacture of formed parts containing inorganic fibres, a silica sol and anionic starch is known from DE-A-26 06 487. However, these formed parts do not contain any inorganic particle-like fillers.

EP-B-0 080 986 (AT-E-13777) discloses a process for manufacturing paper according to which a product containing organic fibres, i.e. cellulose fibres, mineral fillers, anionic colloidal silicic acid and cationic guar is obtained. On account of the high portion of organic fibres, such a product is combustible and therefore not suitable for high temperature applications.

A process for producing a porous inorganic sheet containing inorganic fibres and/or larger flocs, an anionic silica sol and cationic starch is known from US-A-3 253 978. However, such a sheet does not contain any fine inorganic fillers and its strength is inadequate.

A fibrous material with low density which contains inorganic fibres, inorganic fillers and a high portion of cationic guar is known from GB-A-21 27 867. The inorganic fillers are standard fillers that are used in relatively small quantities. Furthermore, borax is added to precipitate guar on the inorganic fibres.

A fibrous sheet material which contains inorganic fibres in a matrix of ball clay is known from GB-A-2 031 043. To control the speed of dewatering, the material can also contain bentonite. Hydrolyzable starch is used as the binder. Furthermore, the material contains a relatively high portion of cellulose fibres.

Production of a thermal insulating material is known from US-A-3 702 279, whereby inorganic fibres are mixed with a binder of an inorganic sol, whereupon the sol gels. This material does not contain any particle-like inorganic additives. No organic binders are used. The material is sintered following drying.

The present invention is based on providing paper, cardboard or paperboard-like material which is on the one hand noncombustible and on the other hand has a high strength and flexibility and can be processed easily. Until now these properties were incompatible, i.e. until now it was considered necessary to use a relatively high portion of organic fibres to manufacture fibrous materials of high strength and flexibility as well as good processibility, which of course increased the combustibility.

To solve this object, the present invention proposes using paper, cardboard or paperboard-like materials containing inorganic fibres, inorganic particle-like additives and organic binders or flocculating agents, characterized in that (1) the particle-like inorganic additives constitute 40–80% by weight of the dry matter of the material;

(2) the inorganic particle-like additives are composed of (2.1) a base filler of which at least 20% by weight has a particle size of $<2$ μm and not more than 20% by weight has a particle size of $>20$ μm on the one hand and $<0.5$ μm on the other hand, and (2.2) an anionic flocculating active pigment of which at least 50% by weight has a primary particle size of $<2$ μm, (3.1) the organic flocculating agent is a cationic polymeric carbohydrate with an average molecular weight of 100,000 to 2,000,000 and a degree of substitution of 0.01 to 0.3 and is present in a quantity of 0.5 to 6% by weight, based on the dry matter of the material, and (3.2) 1000 g of base filler is unable to bind more than 0.1 mMol and 1000 g of anionic flocculating active pigment is able to bind at least 0.1 mMol cationic carbohydrate under flocculation.

The materials according to the present invention are not combustible. They meet the requirements of DIN 4102, Class A. On account of their good strength properties the materials according to the invention can be easily processed further on the basis of cellulose fibres similar to paper, cardboard and paperboard. The materials can be manufactured on the usual paper, cardboard or paperboard machines.

The good strength properties are surprising since the view was hitherto held that the strength values decrease drastically with high filler contents and increasing particle fineness. By comparison, the strength values of the materials according to the present invention increase within further limits with increasing quantities and increasing particle fineness of the particlelike inorganic additives.

According to the invention no fibrous additives are included under "particle-like inorganic additives" since the length of the fibres generally lies in the order of millimeters. "Particle size" is understood as the largest dimension of a particle, which is important, for example, with flattened particles. The particles of the anionic flocculating active pigment sometimes tend to form larger agglomerates. According to the invention, particle size is therefore understood as the size of the primary particle.

The improvement in the strength properties presumably depends on the fact that the anionic flocculating active pigment and the cationic polymeric carbohydrate are absorbed on the one hand by the inorganic fibres and on the other hand by the inorganic particle-like base fillers. The base filler particles settle on the surfaces of the fibres and in this way prevent the as such smooth inorganic fibres from sliding on one another, whereby a nonslip nonwoven fabric is obtained. Inorganic fibres are incapable of developing strength either by binding with hydrogen bonds or through cross linkage in combination with shrinkage as is the case with plant fibres. The strength of a sheet made from purely inorganic fibres is based on "gluing" the individual fibres together at the contact points of the fibres with the aid of organic binders. Such nonwoven fabric has relatively few fibre-fibre points of contact on account of the low flexibility of the inorganic fibres and in addition the retention of organic binder during dewatering in the conventional paper-making process is extremely low. The strength of the finished product is thus low.

On account of their surface size and structure as well as on account of their charge properties the base fillers used according to the invention can form flocs together with a suitable cationic carbohydrate. The inorganic fibres are embedded by the filler during flocculation in the aqueous system. Consequently, according to the invention the number of contact points (fibre-fibre; filler-fibre; filler-filler) as well as the retention of the carbohydrate is increased by the addition of the filler. Good structural strength is only achieved if all fibre-fibre intersection points possible are embedded by the filler completely and without defects and if the flocculating agent is evenly distributed. This is only possible with suitably formed flocs. According to the invention, flocculation is controlled with the aid of the flocculating active pigments. They can displace the point of flocculation on account of their anionic charge potential and, moreover, through formation of a microfloc contribute together with the cationic carbohydrate to good distribution thereof. The anionic flocculating active pigments can in addition close defects in the filler-filler and fibre-filler compound.

The reaction mechanism described makes it clear that this is a very complex system in which synergistic effects can also occur. The individual components of the material according to the invention, i.e. fibres, base filler, anionic flocculating active pigment and cationic carbohydrate, must therefore be matched exactly to one another with respect to type and quantity added.

There are no limitations with respect to the inorganic fibres. It is the aim of the present invention, however, to provide fibrous materials in which the potentially carcinogenic asbestos fibres are replaced by fibres unharmful to health. These include, among others, glass fibres, mineral fibres, silicic acid fibres, basalt fibres and/or aluminium oxide fibres. The thickness and length of the inorganic fibres can fluctuate within a wide range. Preferably at least 80% of the inorganic fibres have a length in the range of approximately 1 to 6 mm. A mixture of inorganic fibres which differ from one another with respect to composition, length and thickness can also be used.

There are also no limitations with respect to the particle-like inorganic base fillers. For example, $SiO_2$, kaolin, aluminium oxide, fuller's earth, gypsum, calcium carbonate, titanium dioxide, zinc oxide, perlite, vermiculite and/or other as such known paper fillers or fillers for synthetic substances and paints are suitable.

Some of these base fillers, such a gypsum and fuller's earth, give off water of crystallization or adsorption water during heating and are in this way fire-retardant. Calcium carbonate, which gives off carbon dioxide at higher temperatures, has a comparable effect.

The content of inorganic base filler generally amounts to 35 to 75% by weight, preferably 55 to 70% by weight, based on the dry matter of the material.

Preferably 35 to 99% by weight of the inorganic base filler has a particle size of $<2$ μm and not more than 10% by weight has a particle size of $>20$ μm.

The anionic flocculating active pigment is preferably aluminium hydroxide, bentonite or colloidal amorphous $SiO_2$. The content of active pigments generally amounts to approximately 1 to 15, preferably 2 to 10% by weight, based on the dry matter of the material.

If an anionic colloidal amorphous $SiO_2$ is used, then it is preferably used in the form of a 30–40% aqueous dispersion. Preferably anionic silica sols, which were obtained through contact of a diluted water glass solution with an acidic cation exchanger and ageing of the sol obtained, are used. They are dispersed in an alkaline medium which reacts with the silicon dioxide surface and there generates a negative charge. The particles repel one another on account of the negative charge and thus bring about stabilization of the product. Suitable commercial products are available, for example, under the name Ludox (Trade Mark for the firm Du Pont), although other products can also be used.

If aluminium hydroxide is used as the active pigment, then it can be produced in status nascendi from an alkali aluminate and an acid, preferably sodium aluminate and sulphuric acid, or from an aluminium salt and alkali, preferably aluminium sulphate and caustic soda.

If bentonite is used as the active pigment, then alkali bentonite capable of swelling is preferred.

The ratio between inorganic particle-like additives and cationic polymeric carbohydrate is preferably such that there is no excess charge so that an optimum floc forms.

Preferred polymeric carbohydrates include cationic starch, cationic amylopectin, cationic galactomannan (for example, guar or cassia) and/or cationic carboxymethylcellulose. The carbohydrates can be cationized in an as such known manner in that the possibly hydrolyzed initial carbohydrates are quaternized with quaternary ammonium compounds. The carbohydrates can, however, also be cationized following the dry cationization process. Polyvinyl alcohols can also be added to the cationic carbohydrates.

The content of polymeric cationic carbohydrate as a rule amounts to 1 to 5, preferably 1 to 3% by weight, based on the dry matter of the material. This depends essentially on the desired field of application. If materials with a high temperature stability are to be produced, then small quantities of polymeric cationic carbohydrate are used. Materials for use at high temperatures include, for example, packing materials used during chemical engineering and motor construction as well as temperaturestable filter materials for hot gases and liquids. Furthermore, with higher carbohydrate concentrations the materials according to the present invention can also be used as insulating material during construction, particularly during dry construction, for example as cable routes and fire protection insulations, for fire doors, wall and ceiling paneling, support layers for heat insulating materials as well as fireproof displays for advertising purposes (in department stores). The construction of motor vehicles is another important field of application since in addition to temperature stability the materials according to the present invention have a low specific weight. Even with a higher content of cationic carbohydrate, the material does not ignite since the cationic carbohydrate merely carbonizes.

The cationic polymeric carbohydrate generally has an average molecular weight of 200,000 to 1,000,000, preferably 300,000 to 800,000 and a degree of substitution of 0.15 to 0.02.

The materials according to the present invention can also contain cationic, anionic or nonionic retention aids. As a rule, these retention aids are common in the paper industry and are preferably added in quantities of approximately 0.02 to 0.2% by weight, based on the dry matter of the material.

A cationic polyacrylamide with a molecular weight of approximately 1 to 10 million or a polyethylene imine with a molecular weight of approximately 80,000 to 300,000 can be used as the retention aid.

The materials according to the present invention can also contain wet strength agents, preferably in a quantity of approximately 0.2 to 5% by weight, based on the dry matter of the material. Suitable wet strength agents are, for example urea formaldehyde or melamine formaldehyde resins, polyamide amine epichlorohydrin resins and the like.

The formation of materials according to the present invention as three-dimensional moulded bodies also forms the subject matter of the present invention. These include tubes, casting shells, filter bodies, insulating walls, packing elements, etc.

The materials according to the present invention are preferably manufactured by mixing an aqueous dispersion of inorganic fibres and the particle-like inorganic base fillers with an aqueous suspension of the active pigment and adding cationic polymeric carbohydrate to this mixture shortly before shaping. Shaping can be carried out, for example, on a paper or cardboard machine. This is referred to as sheet-making. The three-dimensional moulded bodies are preferably produced according to the fibrous casting process. It is also possible, however, to deposit the still damp sheet in a three-dimensional shape and dry it.

Shaping is preferably carried out after flocs have formed in the aqueous mixture following the addition of cationic polymeric carbohydrate.

Shaping is preferably carried out at the end of at least 10 seconds following the addition of cationic polymer carbohydrate. The retention aid is preferably added following the addition of the cationic polymeric carbohydrate.

To obtain homogeneous products, the inorganic fibres and the inorganic base fillers are preferably subjected separately to wet dispersing prior to production of the dispersion, whereupon the separate dispersions are mixed with one another. Selection of a suitable stirring speed, duration of stirring, etc. guarantees that each constituent is optimally dispersed. The dispersing parameters depend, for example, on the nature, length and thickness of the inorganic fibres or on the nature, particle size and specific weight of the base filler particles.

The aqueous dispersion of active pigments is then added to the mixed dispersion of inorganic fibres and inorganic base filler particles, whereupon the cationic carbohydrate is added shortly (approximately 10 to 30 seconds) before sheet-making. The retention agent is subsequently added.

The present invention will be explained on the basis of the following examples.

EXAMPLES 1 to 6

Glass fibre with long fibres (2–6 mm) is pre-dispersed in water. A separate pre-dispersion is then produced from mineral fibres with a fibre length of up to approximately 3 mm. The commercial product "Inorphil" (Trade Mark for the firm Laxa, Sweden) is used as the mineral fibre. The percentages by weight between glass fibres and mineral fibres are given in Table I. A dispersion of kaolin (base filler) is subsequently produced. The particle sizes and the percentages by weight of the types of kaolin used are likewise given in Table I.

The three pre-dispersions are thoroughly mixed with a dispersion of colloidal amorphous $SiO_2$. The water content of the dispersion amounts to approximately 60–70% by weight.

A solution of cationic starch (commercial product Amijel, Q-Tak 210 of the firm Cerestar) is then added (solids content of the solution =1% by weight). The percentages by weight of colloidal $SiO_2$ and cationic starch are likewise given in Table I.

Flocs form following the addition of cationic starch. According to Example 6, a cationic polyacrylamide is also added as retention agent (Nalco 47-32; Trade Mark of the firm Nalco Chemical Co.) in the quantity given in Table I.

Approximately 20 seconds after the cationic starch is added, the aqueous substance is brought to a Rapid-Köthen laboratory sheet-making plant whereupon the aqueous phase is sucked off. A sheet having a thickness of approximately 0.3 mm after drying is obtained. The tensile strengths of the test sheets are given in Table I.

Examples 1 to 6 show that surprisingly and contrary to the level of knowledge in the paper industry today the strength increases sharply with the increasing base filler content and the greater particle fineness with at the same time very good retention values.

The comparative examples 1 and 3 already show the influence of the particle fineness, whereas comparative examples 3 and 4 show the influence of the filler content on the mechanical strength.

Examples 2, 5 and 6 according to the invention show the increases in strength caused by the addition of the anionic flocculating active pigment, whereby the increased strength according to Example 5 over Example 2 is also caused by the higher portion and the greater particle fineness of the base filler.

Example 6 shows that the strength can be increased even further compared with the material of the next comparable Example 5 by using a retention aid.

EXAMPLES 7 to 10

The fibre and filler pre-dispersions are produced according to Examples 1 to 6, whereby the substances and weight ratios given in Table II are used. Mixture of the pre-dispersions with the other constituents as well as sheet-making are likewise carried out according to Examples 1 to 6.

In Example 7 an aluminium hydroxide dispersion, which was produced in situ as aluminium sulphate and sodium hydroxide, is used as the active pigment instead of the colloidal amorphous silicic acid.

Bentonite is used as the active pigment in Example 8. Example 9 was included as a comparative example (without active pigment).

Examples 7 to 10 should illustrate the influence of the various flocculating active pigments on the strength properties of the non-combustible, inorganic materials according to the present invention. The selection and quantity of flocculating active pigment depends to a large extent on the properties of the base filler. The requirements for non-combustibility sharply limit the quantity of organic auxiliary agents, such as carbohydrates, used. By adding active pigments to the base filler, the suspension is "pushed" into the most favourable flocculation range and an acceptable mechanical strength is only achieved through this.

This is demonstrated by comparing the strengths of the materials according to Examples 1, 3 (Table I) and 9, to which no active pigment was added, with the respective values of the remaining examples.

EXAMPLES 11 to 15

Production of the pre-dispersions, mixture of the dispersions as well as sheet-making are carried out according to Examples 1 to 6. The individual substances and their percentages by weight are given in Table III. The Examples given in this Table show that various cationic carbohydrates can be used if they have a suitable degree of substitution (DS) and a suitable molecular weight.

In Example 15 a combination of two different carbohydrates is used which likewise results in suitable strength values.

Corresponding sheets in any thickness can also be manufactured on suitable paper or paperboard machines (endless wire or board machine). Depending on the recipe and the type of machine the total retention amounts to between 85 and 95%. The specific weight can vary in the range of 500 to 1000 kg/m$^3$ depending on the type and quantity of fibrous materials and fillers used. The insulating capability and thus the range of applications depends primarily on the specific weight of the material produced, whereas the temperature stability is first of all directed to the melting point of the fibres. In the recipes examples given, the glass fibres could be replaced by other fibres with a higher temperature stability without any difficulty and without detrimental effects on the mechanical properties.

TABLE I

| | Example No. | | | | | |
|---|---|---|---|---|---|---|
| | 1 | 2 | 3 | 4 | 5 | 6 |
| | % by weight | | | | | |
| Mineral fibre (−3 mm) | 32.5 | 26.5 | 32.5 | 18.5 | 18.5 | 18.5 |
| Glass fibre (2–6 mm) | 15.0 | 11.0 | 15.0 | 9.0 | 9.0 | 9.0 |
| Kaolin No. 1 Sheet structure (46% <2 μm) | 50.0 | 54.5 | — | — | — | — |
| Kaolin No. 2 Sheet structure (71% <2 μm) | — | — | 50.0 | 70.0 | 64.5 | 64.5 |
| Colloidal amorphous $SiO_2$ (particle size 15–20 nm) | — | 5.5 | — | — | 5.5 | 5.5 |
| Cationic starch Molecular weight 800,000–1 million DS: 0.05 | 2.5 | 2.5 | 2.5 | 2.5 | 2.5 | 2.45 |
| Cationic polyacrylamide (Nalco 47-32) | — | — | — | — | — | 0.05 |
| Tensile strength (MPa) | 0.9 | 3.8 | 2.3 | 4.0 | 5.3 | 5.6 |

TABLE I-continued

| | Example No. | | | | | |
|---|---|---|---|---|---|---|
| | 1 | 2 | 3 | 4 | 5 | 6 |
| | % by weight | | | | | |
| (MPa) | | | | | | |

TABLE II

| | Example No. | | | |
|---|---|---|---|---|
| | 7 | 8 | 9 | 10 |
| | % by weight | | | |
| Mineral fibre (−3 mm) | 26.5 | 26.5 | 26.5 | 26.5 |
| Glass fibre (2–6 mm) | 11.0 | 11.0 | 11.0 | 11.0 |
| Kaolin No. 2 Sheet structure (71% <2 μm) | 56.6 | 58.0 | — | — |
| Kaolin No. 3 Sheet structure (45% <2 μm) | — | — | 60.0 | 54.5 |
| Aluminium sulphate | 2.0 | — | — | — |
| Sodium hydroxide | 1.4 | — | — | — |
| Bentonite | — | 2.0 | — | — |
| Colloidal amorphous $SiO_2$ (particle size 15–20 nm) | — | — | — | 5.5 |
| Cationic starch Molecular weight 800,000–1 million DS: 0.05 | 2.5 | 2.5 | 2.5 | 2.5 |
| Tensile strength (MPa) | 4.2 | 4.4 | 1.3 | 4.2 |

TABLE III

| | Example No. | | | | |
|---|---|---|---|---|---|
| | 11 | 12 | 13 | 14 | 15 |
| | % by weight | | | | |
| Mineral fibre (−3 mm) | 19.0 | 27.0 | 27.0 | 18.5 | 27.0 |
| Glass fibre (2–6 mm) | 9.5 | 11.5 | 11.5 | 9.0 | 11.0 |
| Kaolin No. 2 Sheet structure (71% <2 μm) | — | 54.5 | 54.5 | — | 54.0 |
| Calcium carbonate (99% <2 μm) | 68.0 | — | — | 64.5 | — |
| Alkali activated bentonite | 2.0 | — | — | — | — |
| Colloidal amorphous $SiO_2$ (particle size 15–20 nm) | — | 5.5 | 5.5 | 5.5 | 5.5 |
| Cationic guar No. 1 DS: 0.11 | 1.5 | — | — | — | — |
| Cationic guar No. 2 DS: 0.02 | — | 1.5 | — | — | — |
| Cationic guar No. 3 DS: 0.1 | — | — | 1.5 | — | 1.0 |
| Cationic cassia Molecular weight 400,000 | — | — | — | 2.5 | — |
| Cationic starch Molecular weight 800,000–1 million DS: 0.05 | — | — | — | — | 1.0 |
| Tensile strength (MPa) | 4.0 | 4.1 | 4.0 | 4.7 | 4.2 |

What is claimed is:

1. A paper, cardboard or paperboard material containing inorganic fibers, inorganic particulate additives and organic binder or flocculating agents, wherein (A) the particulate inorganic additives constitute 40 to 80% by weight of the dry matter of the material, the inorganic particulate additives are composed of (i) 35–75% by weight of the dry matter of the material of a base filler selected from the group consisting of $SiO_2$, kaolin, aluminum oxide, fuller's earth, calcium carbonate and gypsum, of which 35 to 99% by weight have a particle size of <2 μm and not more than 10% by weight have a particle size of >20 μm, and (ii) 1 to 15% by weight of the dry matter of the material of an anionic flocculating active pigment of which at least 50% by weight have a primary particle size of <2 μm, selected from the group consisting of aluminum hydroxide, bentonite and colloidal amorphous $SiO_2$, and (B) the organic flocculating agent is a cationic polymeric carbohydrate with an average molecular weight of 100,000 to 2,000,000 and a degree of substitution of 0.01 to 0.3 and is present in a quantity of 0.5 to 6% by weight, based on the dry matter of the material, 1000 g of base filler being unable to bind more than 0.1 mMol and 1000 g of anionic flocculating active pigment being able to bind at least 0.1 mMol cationic carbohydrate under flocculation prior to the attachment to the inorganic fiber.

2. A material according to claim 1, wherein the quantity of particulate inorganic additives (A) amounts to approximately 50 to 75% by weight, based on the dry matter of the material.

3. A material according to claim 2, wherein the quantity of particulate inorganic additives (A) amounts to approximately 60 to 70% by weight, based on the dry matter of the material.

4. A material according to claim 2, wherein the inorganic fibers are selected from the group consisting of glass fibers, mineral fibers, silicic acid fibers, basalt fibers and aluminum oxide fibers.

5. A material according to claim 2, wherein at least 80% of the inorganic fibers have a length in the range of 1 to 6 mm.

6. A material according to claim 1, wherein the content of inorganic base fillers (i) amounts to 55 to 70% by weight, based on the dry matter of the material.

7. A material according to claim 1, wherein the base filler aluminum hydroxide obtained in statu nascendi from an alkali aluminate and an acid.

8. A material according to claim 7, wherein the aluminum hydroxide has been obtained in statu nascendi from sodium aluminate and sulphuric acid.

9. A material according to claim 1, wherein the base filler aluminum hydroxide obtained from an base filler aluminum salt and alkali.

10. A material according to claim 9, wherein the aluminum hydroxide has been obtained in statu nascendi from aluminum sulphate and sodium hydroxide.

11. A material according to claim 1, wherein the ratio between the inorganic particulate additives (A) and the cationic polymeric carbohydrate (B) is such that there is no excess charge.

12. A material according to claim 1, wherein the cationic polymeric carbohydrate (B) is selected from the group consisting of cationic starch, cationic amylopectin, a cationic galactomannan and cationic carboxymethylcellulose.

13. A material according to claim 1, wherein the content of cationic polymeric carbohydrate (B) amounts to 1 to 5% by weight, based on the dry matter of the material.

14. A material according to claim 1, wherein the content of cationic polymeric carbohydrate (B) amounts to 1 to 3% by weight, based on the dry matter of the material.

15. A material according to claim 1, wherein the cationic polymeric carbohydrate (B) has been obtained by reacting the initial carbohydrate with a quaternary ammonium compound.

16. A material according to claim 1, wherein the cationic polymeric carbohydrate (B) has an average molecular weight of 200,000 to 1,000,000, and a degree of substitution of 0.15 to 0.02.

17. A material according to claim 16, whrein the cationic polymeric carbohydrate (B) has an average molecular weight of 300,000 to 800,000.

18. A material according to claim 1, containing in addition, a cationic, anionic or nonionic retention aid.

19. A material according to claim 18, wherein the retention aid is present in a quantity of approximately 0.02 to 0.2% by weight, based on the dry matter of the material.

20. A material according to claim 18, wherein the retention aid is a cationic polyacrylamide with a molecular weight of approximately 1 to 10 million or a cationic polyethylene imine with a molecular weight of approximately 80,000 to 300,000.

21. A material according to claim 1, containing, in addition, a wet strength agent.

22. A material according to claim 1, in the form of a three-dimensional moulded body.

23. A process for the manufacture of a paper, cardboard or paperboard material containing inorganic fibers, inorganic particulate additives and organic binder or flocculating agents, wherein (A) the particulate inorganic additives constitute 40 to 80% by weight of the dry matter of the material, the inorganic particulate additives are composed of (i) 35–75% by weight of the dry matter of the material of a base filler selected from the group consisting of $SiO_2$, kaolin, aluminum oxide, fuller's earth, calcium carbonate and gypsum, of which 35 to 99% by weight have a particle size of <2 μm and not more than 10% by weight have a particle size of >20 μm, and (ii) 1 to 15% by weight of the dry matter of the material of an anionic flocculating active pigment of which at least 50% by weight have a primary particle size of <2 μm, selected from the group consisting of aluminum hydroxide, bentonite and colloidal amorphous $SiO_2$, and (B) the organic flocculating agent is a cationic polymeric carbohydrate with an average molecular weight of 100,000 to 2,000,000 and a degree of substitution of 0.01 to 0.3 and is present in a quantity of 0.5 to 6% by weight, based on the dry matter of the material, 1000 g of base filler being unable to bind more than 0.1 mMol and 1000 g of anionic flocculating active pigment being able to bind at least 0.1 mMol cationic carbohydrate under flocculation prior to the attachment to the inorganic fiber, and comprising mixing an aqueous dispersion of said inorganic fibers and said particulate inorganic base fillers (i) with an aqueous suspension of said active pigment (ii), thereafter adding said cationic polymeric carbohydrate (B) to said mixture shortly before shaping, and shaping said mixture.

24. A process according to claim 23, wherein said shaping is carried out after flocs have formed in the aqueous mixture following the addition of said cationic polymeric carbohydrate (B).

25. A process according to claim 23, wherein said shaping is carried out at the end of at least 10 seconds following the addition of said cationic polymeric carbohydrate (B).

26. A process according to claim 23, wherein a retention aid is added following the addition of said cationic polymeric carbohydrate (B).

27. A process according to claim 23, wherein said inorganic fibers, said inorganic base fillers (i) and said active pigments (ii) are subjected separately to wet dispersing prior to production of said dispersion.

28. A process according to claim 1, wherein said mixture is processed on a conventional paper, cardboard or paperboard machine.

29. A process according to claim 1, wherein said mixture is cast, bound and moulded to form a three-dimensional moulded body.

30. A process according to claim 1, wherien the mixture is cast to form a fibrous web, and said fibrous web is deformed while still damp.

* * * * *

UNITED STATES PATENT AND TRADEMARK OFFICE

CERTIFICATE OF CORRECTION

PATENT NO. : 5,294,299

DATED : March 15, 1994

INVENTOR(S) : Zeuner, et al.

It is certified that error appears in the above-identified patent and that said Letters Patent is hereby corrected as shown below:

Col. 12, lines 5,8 & 11 Delete claim " 1 " and substitute
-- 23 --

Signed and Sealed this

Thirtieth Day of May, 1995

*Attest:*

*Attesting Officer*

BRUCE LEHMAN

*Commissioner of Patents and Trademarks*